United States Patent [19]

Audeh et al.

[11] Patent Number: 4,573,530

[45] Date of Patent: Mar. 4, 1986

[54] IN-SITU GASIFICATION OF TAR SANDS UTILIZING A COMBUSTIBLE GAS

[75] Inventors: Costandi A. Audeh, Princeton, N.J.; Robert D. Offenhauer, Bradenton, Fla.

[73] Assignee: Mobil Oil Corporation, New York, N.Y.

[21] Appl. No.: 549,140

[22] Filed: Nov. 7, 1983

[51] Int. Cl.[4] ..... E21B 43/243; C10J 5/00

[52] U.S. Cl. ..... 166/260; 166/261

[58] Field of Search ..... 166/256, 260, 261, 251

[56] References Cited

U.S. PATENT DOCUMENTS

| | | | |
|---|---|---|---|
| 2,780,449 | 2/1957 | Fisher et al. | 166/260 X |
| 2,793,697 | 5/1957 | Simm et al. | 166/260 |
| 3,035,638 | 5/1962 | Parker et al. | 166/260 |
| 3,044,545 | 7/1962 | Tooke | 166/260 |
| 4,353,418 | 10/1982 | Hoekstra et al. | 166/261 X |
| 4,397,352 | 8/1983 | Audeh | 166/260 |

*Primary Examiner*—Stephen J. Novosad
*Attorney, Agent, or Firm*—Alexander J. McKillop; Michael G. Gilman; Charles A. Malone

[57] ABSTRACT

A subterranean, viscous oil-containing formation, e.g. tar sands, which has previously been exploited by an in-situ combustion operation to recover the maximum amount of oil therefrom and leaving a solid coke like residue in the formation, is first saturated with a combustible gas such as methane, ethane, propane, natural gas or mixtures thereof, thereafter reinitiating in-situ combustion and then injecting a mixture of an oxygen-containing gas and steam to convert the coke like residue to a combustible product gas consisting predominantly of carbon monoxide and hydrogen within the formation. The combustible product gas is recovered and may be utilized directly as a fuel gas, or may be utilized as feed stock for petro chemical manufacturing processes.

12 Claims, No Drawings

IN-SITU GASIFICATION OF TAR SANDS UTILIZING A COMBUSTIBLE GAS

FIELD OF THE INVENTION AND BACKGROUND OF THE INVENTION

1. Field of the Invention

This invention relates to a method of recovering a gaseous product gas containing carbon monoxide and hydrogen from a subterranean, viscous oil-containing formation which has previously been exploited by in-situ combustion, and more particularly the present invention relates to injecting a combustible gas into a formation previously exploited by in-situ combustion until the formation is saturated with the gas, reinitiating in-situ combustion, injecting a mixture of an oxygen-containing gas and steam into the formation and producing a combustible product gas from the formation which may be utilized as a fuel or other purposes.

2. Background of the Invention

Increasing worldwide demand for petroleum products, combined with continuously increasing prices for petroleum and products recovered therefrom, has prompted a renewed interest in the sources of hydrocarbons which are less accessible than crude oil of the Middle East and other countries. One of the largest deposits of such sources of hydrocarbons comprises tar sands deposits found in Northern Alberta, Canada, and in the Midwest States of the United States. While the estimated deposits of hydrocarbons contained in tar sands are enormous (e.g., the estimated total of the deposits in Alberta, Canada is 250 billion barrels of synthetic crude equivalent), only a small proportion of such deposits can be recovered by currently available mining technologies (e.g., by strip mining). For example, in 1974 it was estimated that not more than about 10% of the then estimated 250 billion barrels of synthetic crude equivalent of deposits in Alberta, Canada was recoverable by the then available mining technologies. (See SYNTHETIC FUELS, March 1974, Pages 3-1 through 3-14). The remaining about 90% of the deposits must be recovered by various in-situ techniques such as electrical resistance heating, steam injection and in-situ forward and reverse combustion. In addition to tar sands, heavy, viscous crudes and crudes from partially depleted reservoirs are also recoverable by in-situ production techniques.

While details of operating of all of such in-situ techniques vary, a common objective thereof is to lower the viscosity of the hydrocarbon deposits to the point where they can be pumped to the surface of the formation with equipment normally available at the formation site.

Of the aforementioned, in-situ recovery methods, in-situ combustion (both forward and reverse) appears to be the most promising method of economically recovering large amounts of hydrocarbon deposits with currently available technology. The attractiveness of the in-situ combustion methods arises primarily from the fact that it requires relatively little energy necessary for sustaining combustion of the hydrocarbon deposits. In contradistinction, other in-situ techniques, such as electrical resistance heating and steam injection require considerable amounts of energy, e.g., to heat the steam at the surface before it is injected into the petroliferous formation.

Conventional in-situ combustion involves drilling of at least two substantially vertical wells into the formation, the wells being separated by a horizontal distance within the formation. One of the wells is designated an injection well, and the other a production well. The recovery of hydrocarbons is accomplished by raising the temperature around a bore hole to the combustion temperature of the petroliferous deposit with some type of a conventional down hole heater/burner apparatus, and then supporting the combustion by injecting an oxidizing gas, e.g., oxygen or air into the formation. There are two basic processes of in-situ combustion, viz., forward and reverse combustion. Forward combustion is initiated at the oxidant injection well and the combustion front propagates toward the production well. Reverse combustion is initiated at the production well and the combustion front propagates toward the oxidant injection well. Hydrocarbon vapors produced during the combustion process are recovered at the surface of the formation and stored in appropriate containers. The combustion is conducted at a temperature not to exceed 1500° F. for about 12 months until the viscosity of oil deposits is reduced to 700–800 cp, generally considered necessary for pumping the oil to the surface of the formation. Further details of forward and reverse in-situ combustion techniques are set forth in SYNTHETIC FUELS, March 1974, pages 3–4 through 3–14, and in THE TAR SANDS OF CANADA by F. W. Camp, pages 27–34, Cameron Engineers, Inc., Denver, Col., 2nd Edition (1974), the entire contents of which are incorporated herein by reference. Modified in-situ combustion techniques using a combination of oxygen and other chemical substances are also known in the art. For example, Heilman et al., U.S. Pat. No. 2,718,263 uses a mixture of oxygen-containing gas and fuel to generate heat in the formation, and Elzinga, U.S. Pat. No. 3,087,541, injects fuel into the formation only after the combustion has started. Both of these modified in-situ prior art combustion processes use fuels injected externally into the formation either simultaneously with oxygen or after the injection of oxygen to control the direction of speed of propagation of the combustion front.

After the maximum amount of hydrocarbon has been recovered by an in-situ combustion operation, there remains in the formation a considerable amount of hydrocarbons, particularly solid hydrocarbon materials in the form of a coke like residue distributed on the formation matrix. A method for converting such solid hydrocarbons to a combustible gas consisting predominantly of gaseous carbon monoxide and hydrogen within the formation by injecting an oxygen-containing gas and steam into the formation and recovering the combustible gas therefrom which may be utilized as fuel or feed gas for manufacturing operations is described in U.S. Pat. No. 4,026,357 to Redford.

U.S. Pat. No. 4,397,352 to Audeh discloses an improved in-situ combustion process for the recovery of oil from tar sand formations wherein a combustible gas is introduced into the formation prior to in-situ combustion.

Accordingly, it is a primary object of this invention to provide an improvement in the prior art known process for gasification of a subterranean, viscous oil containing formation previously exploited by in-situ combustion so as to produce a combustible gas in the formation consisting predominantly of carbon monoxide and hydrogen that is recovered.

SUMMARY OF THE INVENTION

This invention relates to a method for the in-situ recovery of a combustible product gas consisting essentially of carbon monoxide and hydrogen from a subterranean, viscous oil-containing formation including tar sand deposits traversed by at least one injection well and one production well and wherein said oil-containing formation has previously been subjected to an in-situ combustion operation for a period of time sufficient to recover the maximum amount of oil therefrom and leaving a solid, coke like residue on the formation mineral matrix, comprising the steps of introducing a combustible gas selected from the group consisting of methane, ethane, propane, natural gas or mixtures thereof into the formation via said injection well in an amount to substantially saturate the formation with said gas, introducing an oxygen-containing gas into the formation via said injection well to reinitiate in-situ combustion therein, thereafter introducing a mixture of an oxygen-containing gas and steam into the formation via said injection well causing conversion of the coke-like material to a combustible product gas consisting essentially of carbon monoxide and hydrogen in the formation, and recovering the combustible product gas from the subterranean formation via said production well.

DESCRIPTION OF THE PREFERRED EMBODIMENT

Disclosed herein is a method for in-situ gasification of a subterranean, viscous oil-containing formation including a tar sand deposit which has previously been exploited by conventional in-situ combustion wherein prior to gasification the formation is saturated with a combustible gas and in-situ combustion reinitiated followed by injecting a mixture of an oxygen-containing gas and steam into the hot formation so as to generate a combustible product gas in the formation consisting essentially of carbon monoxide and hydrogen which is recovered and utilized as a fuel or other purposes.

A subterranean, viscous oil-containing formation which can be subjected to the process of the present invention is any formation containing sources of hydrocarbons difficult to recover by conventional techniques. Suitable formations are tar sand deposits, deposits of heavy petroleum crudes (having a density of 0.95–1.05 g/cm$^3$) and deposits of lighter crudes depleted to some extent by conventional techniques. The typical density of such partially depleted formation is 0.80–1.05 g/cm$^3$.

The subterranean, viscous oil-containing formation including tar sand deposits is penetrated by at least one injection well and at least one spaced-apart production well, both wells of which are in fluid communication with substantially the entire vertical thickness of the formation. The oil-containing formation has previously been subjected to a conventional in-situ combustion operation as described above to recover the maximum amount of oil therefrom and leaving a solid, coke like residue on the formation mineral matrix.

After the oil-containing formation has been exploited by in-situ combustion, a combustible gas such as methane, ethane, propane, natural gas or mixtures thereof is injected into the formation via the injection well. Injection of the combustible gas is continued until the formation is substantially saturated with gas. In this connection, a point of relative saturation of the formation with the gas is defined as a point at which the formation cannot absorb appreciable additional quantities of gas beyond those which have already been absorbed.

The pressure under which the combustible gas is introduced into the formation will be determined by the depth of the formation below the surface of the earth and by the existing pressure at the depth. For example, in the case of a tar sand deposit and for a relatively light hydrocarbon gas, the gas is introduced under a pressure of 20 atm to 100 atm, preferably 60 atm to 80 atm, and most preferably 65 atm to 70 atm, and at a temperature of −40° C. to 100° C., preferably 0° C., and most preferably 25° C. to 35° C.

Thereafter, an oxygen-containing gas such as air, oxygen-enriched air, or substantially pure oxygen is injected into the formation via the injection well, and the combustion reaction is reinitiated in the combustible gas saturated formation immediately adjacent to the injection well either spontaneously or by several known means, such as by the use of a gas fired downhole heater or a downhole electric heater or by chemical means.

Once in-situ combustion has been attained, steam is comingled with the oxygen-containing gas and the mixture is injected into the formation via the injection well. The ratio of oxygen to steam is adjusted to sustain the combustion reaction and preferably maintain a combustion zone temperature above about 1000° F. so as to provide the necessary heat for forming the combustible product gas by the reaction of oxygen and steam in the formation with the carbon residue to generate carbon monoxide and hydrogen. The ratio of oxygen to steam varies from 0.3 mols to 1.5 mols, and preferably is 0.6 to 1.35 mols. The combustible product gas consisting predominantly of carbon monoxide and hydrogen is produced from the production well, although some methane and carbon dioxide is produced and some liquid hydrocarbons may be produced as well. The produced $CO/H_2$ gas may be utilized as a fuel gas, or fed into additional processing equipment depending on the manufacturing use to be made of the gases. The combustible gas previously introduced into the formation and which preferably saturates the formation, aids in initiating and sustaining the gasification reaction, thereby markedly accelerating the entire combustion process and increasing the yield of product gas consisting predominantly of carbon monoxide and hydrogen.

In still another embodiment of the present invention, the process may be applied to a subterranean, viscous oil-containing formation including a tar sand deposit that has not been exploited or has only been partially depleted of viscous oil. The viscous oil-containing formation is first saturated with a combustible gas as described above and thereafter an in-situ combustion operation is initiated in the usual manner, i.e., the temperature of the formation is brought to or near the combustion temperature and oxygen or air is injected into the formation in a conventional manner as described in S. M. Farouq Ali, "A Current Appraisal of In-Situ Combustion Field Tests", THE JOURNAL OF PETROLEUM TECHNOLOGY, pp. 477–486, (April 1972), the entire contents of which are incorporated herein by reference.

After combustion has been attained, a mixture of an oxidizing gas as described above and steam is injected into the formation via the injection well to produce a combustible product gas consisting predominantly of carbon monoxide and hydrogen by partial oxidation of hydrocarbons in-situ. The product gas is recovered from the formation via the production well. Some oil can be recovered from the formation prior to or even during gasification. The product gas constituents consisting predominantly of carbon monoxide and hydrogen may be optimized by controlling the ratio of oxidizing gas to steam. The ratio of oxidizing gas to steam controls the peak temperature and influences the relative rate of the water/gas-shift reaction. For this embodiment, the ratio of oxygen to steam varies from 0.3 to 1.5 mols, and preferably is 0.8 to 1.2 mols. Also, as described above the combustion zone temperature is maintained above about 1000° F.

In the present invention, the injection pressure of the oxidizing gas and the back pressure on the production well may be adjusted to promote the water/gas-shift reaction in the formation thereby producing a product gas composed predominantly of carbon monoxide and hydrogen.

From the foregoing specification one skilled in the art can readily ascertain the essential features of the invention and without departing from the spirit and scope thereof can adopt it to various diverse applications.

What is claimed is:

1. A method for the in-situ recovery of a combustible product gas consisting essentially of carbon monoxide and hydrogen from a subterranean, viscous oil-containing formation including tar sand deposits traversed by at least one injection well and one production well and wherein said oil-containing formation has previously been subjected to an in-situ combustion operation for a period of time sufficient to recover the maximum amount of oil therefrom and leaving a solid, coke like residue on the formation mineral matrix, comprising the steps of:

(a) introducing a combustible gas selected from the group consisting of methane, ethane, propane, natural gas or mixtures thereof into the formation via said injection well in an amount to substantially saturate the formation with said gas;

(b) introducing an oxygen-containing gas into the formation via said injection well to reinitiate in-situ combustion therein;

(c) thereafter introducing a mixture of an oxygen-containing gas and steam into the formation via said injection well causing conversion of the coke-like material to a combustible product gas consisting essentially of carbon monoxide and hydrogen in the formation; and (d) recovering the combustible product gas from the subterranean formation via said production well.

2. A method according to claim 1 wherein the oxygen-containing gas is air.

3. A method according to claim 1 wherein the oxygen-containing gas is oxygen-enriched air.

4. A method according to claim 1 wherein the oxygen-enriched air is substantially pure oxygen.

5. A method according to claim 1 wherein the ratio of oxygen to steam injected during step (c) is maintained at a sufficient ratio to effect a controlled combustion temperature in the formation above about 1000° F.

6. A method according to claim 5 wherein the ratio of oxygen to steam varies from 0.3 to 1.5 mols.

7. A method for the in-situ recovery of a combustible product gas consisting essentially of carbon monoxide and hydrogen from a subterranean, viscous oil-containing formation including tar sand deposits traversed by at least one injection well and one production well comprising the steps of:

(a) injecting a combustible gas selected from the group consisting of methane, ethane, propane, natural gas or mixtures thereof into the formation via said injection well in an amount to substantially saturate the formation with said gas;

(b) injecting an oxygen-containing gas into the formation via said injection well to establish an in-situ combustion front in said formation;

(c) thereafter injecting a mixture of an oxygen-containing gas and steam into the formation via said injection well to react with oil in said formation by partial oxidation to form a combustible product gas consisting essentially of carbon monoxide and hydrogen; and (d) recovering the combustible product gas from the formation via said production well.

8. A method according to claim 7 wherein the oxygen-containing gas is air.

9. A method according to claim 7 wherein the oxygen-containing gas is oxygen-enriched air.

10. A method according to claim 7 wherein the oxygen-enriched air is substantially pure oxygen.

11. A method according to claim 7 wherein the mols ratio of oxygen to steam injected during step (c) is maintained at a sufficient ratio to effect a controlled combustion temperature in the formation above about 1000° F.

12. A method according to claim 11 wherein the weight ratio of oxygen to steam varies from 0.3 to 1.5 mols.

* * * * *